US011885557B2

(12) United States Patent
Kim

(10) Patent No.: US 11,885,557 B2
(45) Date of Patent: Jan. 30, 2024

(54) REFRIGERATOR

(71) Applicant: LG Electronics Inc., Seoul (KR)

(72) Inventor: Nayoung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 180 days.

(21) Appl. No.: 17/363,929

(22) Filed: Jun. 30, 2021

(65) Prior Publication Data

US 2022/0003488 A1 Jan. 6, 2022

(30) Foreign Application Priority Data

Jul. 1, 2020 (KR) ..... 10-2020-0081020

(51) Int. Cl.
*F25D 23/02* (2006.01)
*F25D 23/08* (2006.01)
*F25D 29/00* (2006.01)

(52) U.S. Cl.
CPC ..... *F25D 23/028* (2013.01); *F25D 23/087* (2013.01); *F25D 29/005* (2013.01); *F25D 2400/08* (2013.01); *F25D 2400/36* (2013.01)

(58) Field of Classification Search
CPC .. F25D 23/087; F25D 29/005; F25D 2400/36; F25D 2400/361; F25D 23/028; F25D 23/064; B29L 2031/724
See application file for complete search history.

(56) References Cited

U.S. PATENT DOCUMENTS 8,960,934 B2 * 2/2015 Sung ..... F25D 29/005 362/218
2015/0192352 A1 * 7/2015 Sung ..... F25D 23/028 29/890.035
2018/0164033 A1 * 6/2018 Lee ..... G09G 3/2096
2018/0187966 A1 * 7/2018 Lee ..... F25D 17/042
(Continued)

FOREIGN PATENT DOCUMENTS

CN 106091526 11/2016
CN 106091526 A * 11/2016
(Continued)

OTHER PUBLICATIONS

Extended European Search Report in European Appln. No. 21182911.4, dated Dec. 2, 2021, 9 pages.
(Continued)

*Primary Examiner* — Lionel Nouketcha
(74) *Attorney, Agent, or Firm* — Fish & Richardson P.C.

(57) ABSTRACT

A refrigerator includes: a cabinet and a door configured to open and close the cabinet. The door includes a cap decoration defining an upper surface of the door and having an opening; an outer plate defining a front appearance of the door and including a display configured to indicate operation information; a door liner coupled to the outer plate and defining a rear surface of the door; an insulating material filled between the outer plate and the door liner; an inner case coupled to the outer plate and the cap decoration inside of the door and including an accommodating space that
(Continued)

communicates with the opening; and a display assembly inserted through the opening from an outside of the door and disposed inside of the case, and the cap decoration includes a case inserting portion into which the inner case is inserted and restrained.

18 Claims, 13 Drawing Sheets

(56) References Cited

U.S. PATENT DOCUMENTS

| | | | | |
|---|---|---|---|---|
| 2019/0170434 | A1* | 6/2019 | Kim | F25D 23/028 |
| 2020/0284503 | A1* | 9/2020 | Gerstmayr | F25D 23/028 |

FOREIGN PATENT DOCUMENTS

| | | |
|---|---|---|
| CN | 106802059 | 6/2017 |
| CN | 106839639 | 6/2017 |
| KR | 1020170040710 | 4/2017 |
| KR | 20180067391 | 6/2018 |

OTHER PUBLICATIONS

Office Action in Korean Appln. No. 10-2020-0081020, dated Aug. 30, 2022, 6 pages (with English translation)KROA.

* cited by examiner

REFRIGERATOR

CROSS-REFERENCE TO RELATED APPLICATION

This application claims priority to and the benefit of Korean Patent Application No. 10-2020-0081020, filed on Jul. 1, 2020, the disclosure of which is incorporated herein by reference in its entirety.

TECHNICAL FIELD

The present disclosure relates to a refrigerator.

BACKGROUND

A refrigerator is a home appliance capable of storing food at a low temperature in an internal storage space closed by a door. The refrigerator may store the food in an optimal state by cooling an inside of the storage space. The storage space may be cooled using cold air generated by heat exchange with refrigerant circulating in a refrigeration cycle.

Refrigerators have become larger in size and more multifunctional according to changes in dietary life and the trend of high-quality products. In addition, refrigerators including various structures and convenience devices may provide user convenience and efficiently use the internal space thereof.

As an example of the convenience device, a display may be disposed on the door of the refrigerator to indicate an operation state of the refrigerator. In addition, the display may display various pieces of operation information of the refrigerator in the form of numbers, letters, symbols, or pictures.

The user may identify the operation state of the refrigerator by checking the information displayed on the display and manipulate to drive the refrigerator.

In some examples, a refrigerator includes an outer plate made of metal and defining a front surface of a refrigerator door. A display including a plurality of through-holes is disposed on the outer plate and a touch manipulating portion is disposed on the outer plate in order for the user to manipulate the touch. In addition, the refrigerator includes a display assembly and a touch assembly inside of the door.

However, for such a refrigerator, when an inner case is coupled to mount the display assembly, assembly workability thereof is deteriorated and a screw fastening is required to couple to a door cap decoration, thereby increasing the number of assembly process.

SUMMARY OF THE DISCLOSURE

The present embodiment provides a refrigerator capable of improving assembly workability and productivity of a refrigerator door.

The present embodiment provides a refrigerator capable of maintaining a mounting position of an inner case by a simple assembly operation.

Particular implementations of the present application provide a refrigerator that includes a cabinet, and a door configured to open and close the cabinet. The door may include a cap, an outer plate, and an inner plate. The cap defines an upper surface of the door. The outer plate may have a front surface and a rear surface. The front surface may define a front appearance of the door. The outer plate may include a display configured to indicate operation information at the front surface. The inner case may be disposed at the rear surface of the outer plate and coupled to the display. The inner case may define an accommodating space. A front surface of the inner case may be coupled to the outer plate and an upper surface of the inner case may be coupled to the cap. The cap may include a case inserting portion that restrains the upper surface of the inner case.

In some implementations, the refrigerator can optionally include one or more of the following features. The inner case may include a case upper surface that defines the upper surface of the inner case and that contacts an inner upper surface of the cap, and a case front surface that extends away from the accommodating space and that contacts the rear surface of the outer plate. The refrigerator may include a sealing member disposed at the case upper surface and the case front surface and providing sealing between the inner case, the outer plate, and the cap. The inner case may include a restraining end that extends along a circumference of the case upper surface. The cap may include a restraining protrusion that protrudes from the case inserting portion. The restraining protrusion may be configured to be engaged with and restrained at the restraining end of the inner case. A lower surface of the restraining protrusion may include an inclined surface. An upper surface of the restraining protrusion may be configured to be engaged with and restrained at the restraining end of the inner case. A sealing member may be disposed between the upper surface of the inner case and the inner upper surface of the cap. The upper surface of the restraining protrusion of the cap may be vertically spaced apart from the restraining end of the inner case by a set distance. The set distance may be smaller than a vertical thickness of the sealing member. The inner case may be configured to be inserted into the case inserting portion to thereby engage the restraining end of the inner case with the restraining protrusion of the cap and retrain the restraining end of the inner case at the restraining protrusion of the cap. The inner case may be configured to be coupled to the outer plate based on a lower portion of the inner case being rotated toward the outer plate. The refrigerator may include an upper sealing member and a lower sealing member. The upper sealing member may be positioned at the case upper surface and an upper portion of the case front surface and provide sealing between the inner case and the cap. The lower sealing member may be positioned along the case front surface and provide sealing between the inner case and the outer plate. The upper sealing member may be adhered to the inner case. The lower sealing member may be adhered to the inner case and the outer plate. The case inserting portion may extend toward the inner case and be configured to contact an outer circumference of the upper surface of the inner case. The cap may include an opening that communicates with the accommodating space. The refrigerator may include a decoration cover configured to cover an upper side of the opening to open and close the opening. The inner case may include a fastening portion positioned at an upper side of the inner case and be configured to fasten a screw that extends through the decoration cover and the cap. The case inserting portion may include a protrusion configured to accommodate the fastening portion of the inner case. A front side of the upper surface of the inner case may be restrained at the outer plate. Opposite lateral sides and a rear side of the upper surface of the inner case may be restrained at the case inserting portion. The door may include an insulating material included in the door. The refrigerator may include a display assembly inserted through the opening of the cap and received in the accommodating space of the inner case. The sealing member may be made of a compressible material. The upper sealing member may be adhered to the case upper surface. The lower sealing member may be adhered to the case front surface. The display may define a plurality of through-holes configured to indicate the operation information.

According to an embodiment of the present disclosure, a refrigerator includes: a cabinet having a storage space and a door configured to open and close the cabinet; the door includes a cap decoration defining an upper surface of the door; an outer plate defining a front appearance of the door and including a display configured to indicate predetermined operation information; and an inner case disposed on a rear surface of the outer plate, coupled to a rear side of the display, and including an accommodating space; a front surface of the inner case is coupled to the outer plate and an upper surface of the inner case is coupled to the cap decoration, and the cap decoration may include a case inserting portion configured to restrain an upper surface of the inner case.

The inner case may include a case upper surface defining the upper surface of the inner case and that contacts an inner upper surface of the cap decoration and a case front surface that extends outward from the accommodating space and contacts an inner surface of the outer plate.

The refrigerator may include a sealing member made of compressive material and disposed on the case upper surface and the case front surface and configured to seal between the inner case, the outer plate, and the cap decoration.

The inner case may include a restraining end that extends outward along a circumference of the case upper surface and the cap decoration may include a restraining protrusion that protrudes inward from the case inserting portion and is engaged with and restrained by the restraining end.

A lower surface of the restraining protrusion may be inclined upward toward a protruding portion and an upper surface of the restraining protrusion may be engaged with and restrained by the restraining end.

A sealing member may be disposed between the upper surface of the case and a lower surface of the cap decoration, an extension line of the upper surface of the restraining protrusion may be spaced apart from the restraining end by a set distance, and the set distance may be smaller than a thickness of the sealing member.

The inner case may be inserted into the case inserting portion to engage and restrain the restraining end with and by the restraining protrusion and the inner case may be coupled to the outer plate by rotating a lower portion of the inner case toward the outer plate.

The refrigerator may further include an upper sealing member that is adhered to the case upper surface and an upper portion of the case front surface and configured to seal between the inner case and the cap decoration; and a lower sealing member adhered under the upper sealing member along the case front surface and configured to seal between the inner case and the outer plate, and a surface of the upper sealing member may be adhered to the inner case and two surfaces of the lower sealing member may be adhered to the inner case and the outer plate.

The case inserting portion may extend downward to contact an outer circumference of the upper surface of the inner case.

The cap decoration may include a decoration opening that communicates with the accommodating space and a decoration cover may be configured to cover an upper side of the decoration opening to open and close the decoration opening.

A fastening portion may be disposed at an upper side of the inner case, may protrude rearward, and a screw may be fastened to the fastening portion through the decoration cover and the cap decoration and the case inserting portion may include a protrusion that protrudes rearward to accommodate the fastening portion.

A front side of the upper surface of the inner case may be restrained by the outer plate and both sides and a rear side of the upper surface of the inner case may be restrained by the case inserting portion.

The door includes an insulating material filled in the door; and a display assembly inserted through the decoration opening form an outside of the opening and accommodated in the accommodating space.

The refrigerator according to the embodiment of the present disclosure may expect the following effects.

According to an embodiment of the present disclosure, the cap decoration, the outer plate, and the inner case may be easily coupled before injecting the foaming liquid to mold the insulating material when a door is assembled.

In particular, the inner case may be inserted into, engaged with, and restrained by the case inserting portion of the cap decoration. Therefore, the inner case may be fixed and mounted at the accurate position by inserting and mounting the inner case without fastening a screw for additional coupling.

A sealing member made of compressible material may be disposed on an upper surface of the inner case to seal and tightly fix between the cap decoration and the upper surface of the inner case when temporarily fixing the inner case. Therefore, even if the foaming liquid is injected into the door to mold the insulating material, inflow of the foaming liquid or change of the position of the inner case due to a pressure of the foaming liquid may be prevented.

Further, the sealing member disposed on the front surface of the inner case may seal and contact the inner case and the outer plate to firmly fix the inner case.

In addition, an upper sealing member disposed on the upper surface and an upper portion of a front surface of the inner case is not attached to the cap decoration, but is attached to the inner case, and a lower sealing member disposed under the upper sealing member is attached to the front surface of the inner case and both surfaces of the outer plate. With this structure, the inner case may be attached to an outer case without blocking the insertion and the mounting of the upper surface of the inner case into and on the case inserting portion.

Therefore, the operation of assembling and mounting the inner case may be significantly reduced, and in particular, the screw fastening operation to fix the inner case may be significantly reduced. Thereby, the number of assembly process may be reduced and productivity thereof may be improved.

In addition, provision of the insulating material may be prevented and a mounted state of the inner case may be maintained at an accurate position by temporary fixing the cap decoration to the inner case without fixing the inner case using a plurality of screws.

DETAILED DESCRIPTION OF EXEMPLARY IMPLEMENTATIONS

Figure 1:
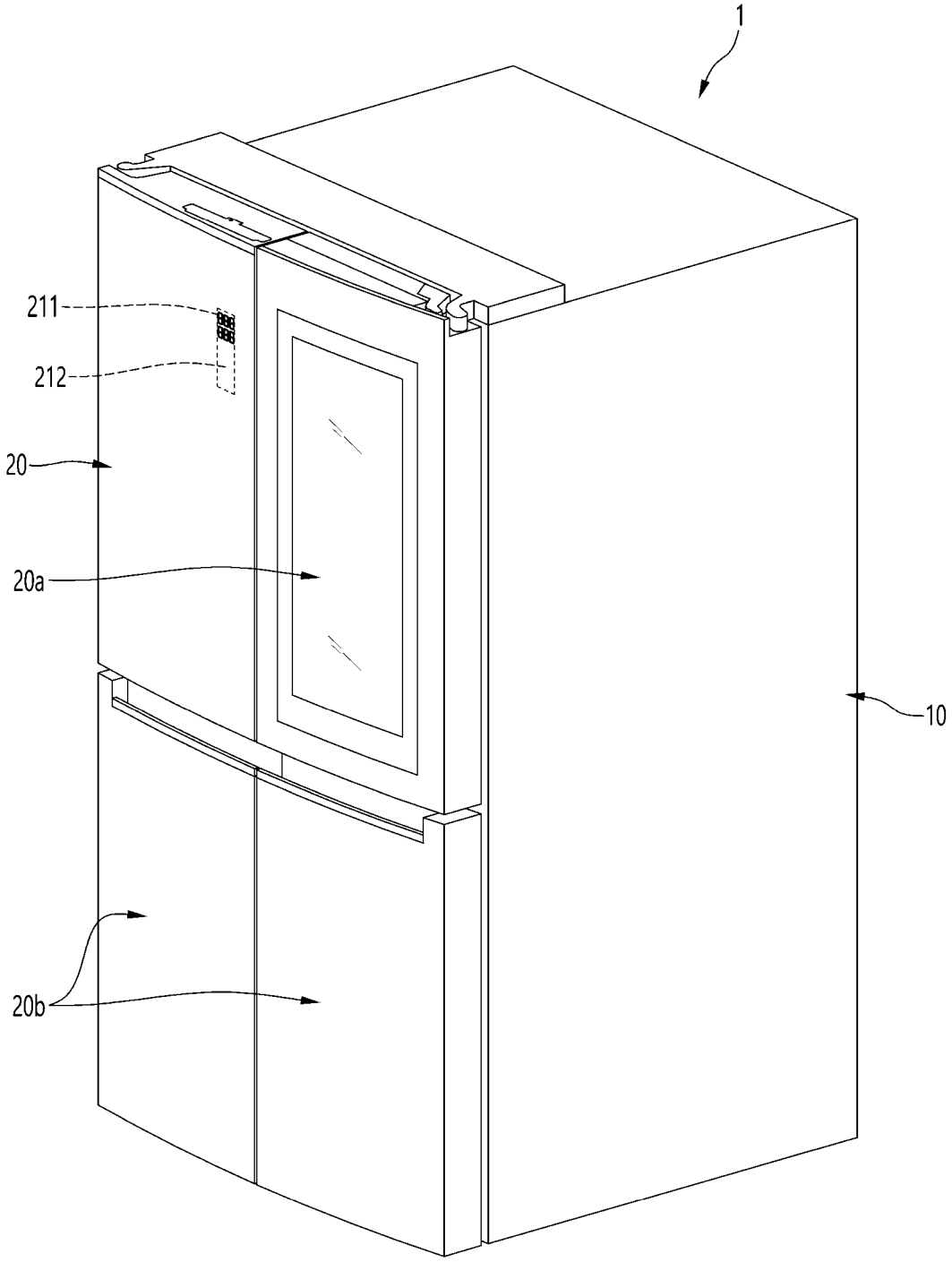
FIG. 1 is a perspective view of an example refrigerator.

Hereinafter, some embodiments of the present disclosure will be described in detail with reference to the accompanying drawings. Reference now should be made to the drawings, in which the same reference numerals are used throughout the different drawings to designate the same or similar components. In addition, a detailed description of a well-known configuration relating to the present disclosure or the function thereof may be omitted if it is apparent for the skilled person in the art.

In addition, the embodiment of the present disclosure is described by exemplifying a display disposed on a refrigerating portion door among a pair of refrigerating portion doors of a bottom freeze type refrigerator for convenience of explanation and understanding, but the present disclosure may be applied to all types of refrigerators including a door.

FIG. 1 is a perspective view of an example refrigerator.

Directions are defined for convenience of explanation and understanding. Hereinafter, a direction toward the floor may be referred to as "a downward direction" with respect to the floor on which a refrigerator 1 is installed and a direction opposite to the downward direction and toward a top of a cabinet 10 may be referred to as "an upward direction". In addition, a direction toward a door 20 may be referred to as "a forward direction" and a direction toward an inside of the cabinet 10 from the door 20 may be referred to as "a rearward direction". In addition, undefined directions may be determined for each drawing.

As shown, according to an embodiment of the present disclosure, an outer appearance of the refrigerator 1 may be defined by a cabinet 10 including a storage space and doors 20, 20*a*, and 20*b* disposed on a front surface of the cabinet 10 to open and close the storage space.

The storage space of the cabinet 10 may be divided into an upper portion and a lower portion. A refrigerating portion may be disposed at the upper portion thereof and a freezing portion may be disposed at the lower portion thereof. A plurality of doors 20, 20*a*, and 20*b* may be disposed on the opened front surface of the storage space to open and close spaces thereof. The door may open and close the storage space in a sliding or rotation manner and define a front appearance of the refrigerator 1 in a closed state.

The door may include a pair of refrigerating portion doors 20 and 20*a* to close the refrigerating portion and a pair of freezing portion doors 20*b* to close the freezing portion. Both sides of the pair of refrigerating portion doors 20 and 20*a* and the pair of freezing portion doors 20*b* are rotatably coupled and may open and close the refrigerating portion and the freezing portion based on the rotation.

Meanwhile, although not shown, a dispenser may be disposed on the front surface of the refrigerating portion door 20 to dispense water or ice. In addition, although not shown in detail, the refrigerating portion door 20*a* at the right side among the refrigerating portion doors 20 and 20*a* on the left and right sides may include a main door defining an additional door storage space and an opening and a sub door to open and close the main door. A portion of the sub door may be selectively transparent so that the user may see the door storage space.

In addition, a display 211 and a touch manipulating portion 212 may each be disposed on the left-sided refrigerating portion door 20 at a height at which a user easily manipulates and identifies the display 211 and the touch manipulating portion 212. Hereinafter, structures of the display 211 and the touch manipulating portion 212 are described, so the refrigerating portion door 20 on the left side is referred to as a door 20. In addition, the embodiment of the present disclosure is not limited to the refrigerating portion door 20 on the left side, but the embodiment of the present disclosure may be applied to all doors including the display 211 inserted through an upper side of the door and to display on a front surface of the door 20 and/or the touch manipulating portion 212 manipulated by touching the front surface of the door 20.

Figure 2:
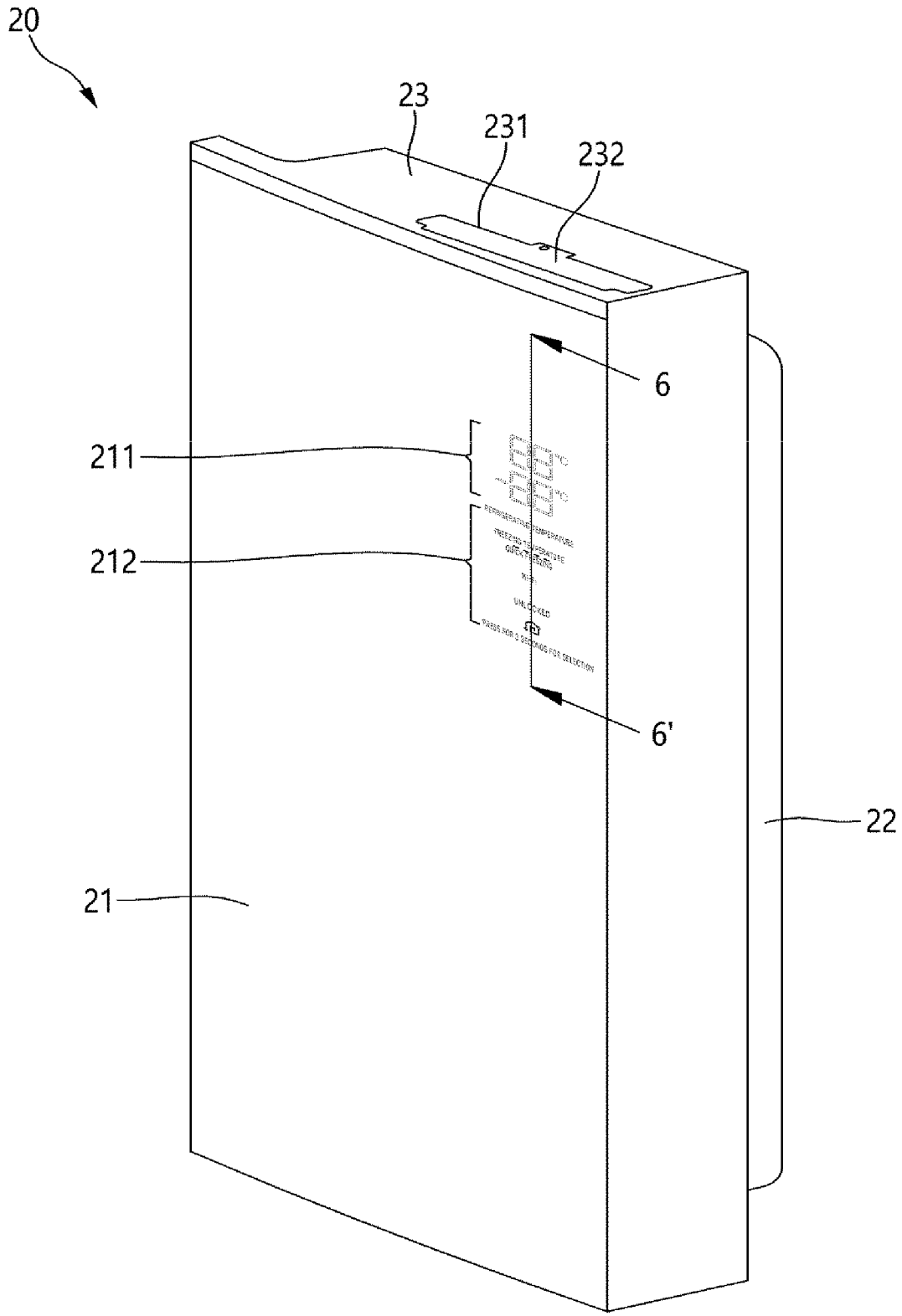
FIG. 2 is a perspective view of a door of the refrigerator.
Figure 3:
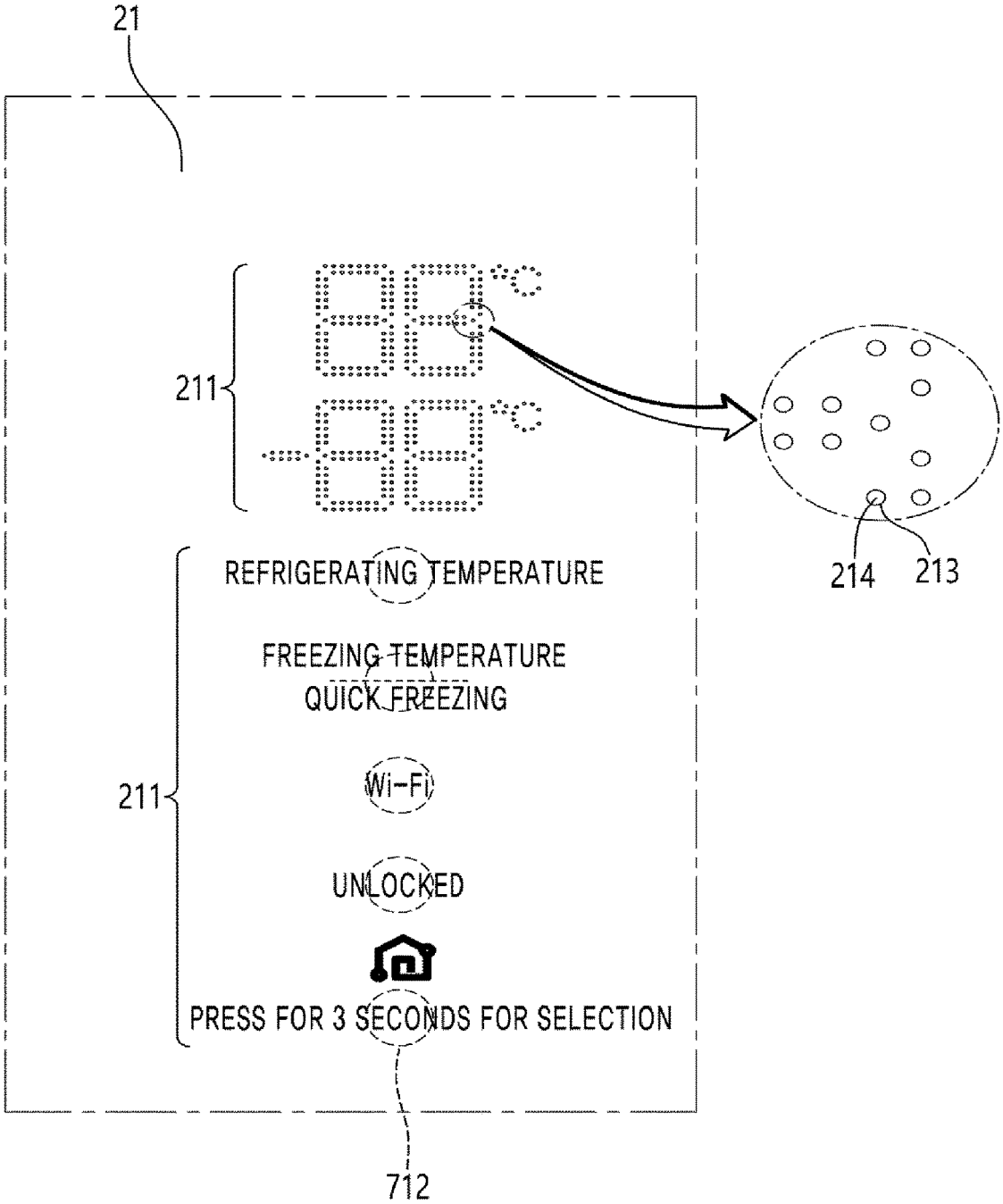
FIG. 3 is an enlarged view of a display and a touch manipulating portion of the door.

FIG. 2 is a perspective view of a door of the refrigerator. FIG. 3 is an enlarged view of a display and a touch manipulating portion of the door.

As shown in the drawing, an outer appearance of the door 20 may be defined by coupling an outer plate 21 defining a front appearance, a door liner 22 defining a rear appearance of the door 20, and a cap decoration 23 disposed at an upper side and a lower side of the door 20.

The outer plate 21 may define the front appearance of the door 20, may have a plate shape, and may be made of metal. The outer plate 21 may be formed of a stainless steel plate or a color steel plate (made of vinyl coated metal (VCM) and pre-coated metal (PCM)) having a stainless texture. For example, the outer plate may have a thickness of about 0.5 mm. The front surface of the outer plate 21 exposed to the outside may be subjected to anti-fingerprint treatment, may have a specific color, pattern, a shape, or a hairline with a metal texture.

Meanwhile, the outer plate may include a display 211 and a touch manipulating portion 212.

The display 211 indicates an operation state of the refrigerator 1 to outside by symbols or numbers, and the like, based on transmission of light from an inside of the door 20 and the user may identify operation information of the refrigerator 1 from outside.

The display 211 may be visible from the outside by a plurality of through-holes 213 defined in a partial area of the outer plate 21. The display 211 may include a set of the plurality of through-holes 213 having a continuous predetermined arrangement to display numbers or symbols. For example, the set of the plurality of through-holes 213 may have a 7-segment shape and may be arranged in a form of specific symbol, a shape of pattern, or the letter to indicate the state of the refrigerator 1.

The arrangement of the through-hole 213 corresponds to an arrangement of a plurality of through-holes 312 and 614 described below and light may be transmitted to the through-hole 213 from a light emitting member 511 of a display assembly 40. In addition, the through-hole 213 of the outer plate 21 may be referred to as a first through-hole 213 for distinguishing from the through-hole 312 of the display cover 30 and the through-hole 614 of the display assembly 40.

The first through-hole 213 may be a fine hole having a small diameter. For example, the first through-hole 213 may have a diameter of 0.4 to 0.7 mm and may be formed in various ways by laser processing, etching, or Numerically Controlled Turret (NCT) process. The first through-hole 213 has a small size and is filled with a hole filling member 214. Thus, the first through-hole 213 may not be exposed to outside when the light emitting member 511 of the display assembly is not turned on. In addition, when the light emitting member 511 is turned on, the light is transmitted through the first through-hole 213 to indicate information.

In detail, the light may be transmitted through the first through-holes 213 provided at positions corresponding to those of the light emitting members 511 transmitting the light among the first through-holes 213. In addition, based on the transmission of the light through the first through-holes 213, the first through-holes 213 have a shape of specific numbers or the letter to transmit information to the user.

That is, when at least a portion of the light emitting member 511 is turned on, the light passing through the first through-hole 213 may be visible from the outside by transmitting the light through the first through-hole 213 corresponding to the turned-on light emitting member 514 among the plurality of first through-holes 213. In this case, the first through-holes 213 may have a shape of specific number, character, or picture by a combination of the exposed first through-holes 213 to transmit information to the user.

In addition, when the light emitting member 511 is turned off and light is not transmitted to the inside of the door 20, the display 211 is not easily visible when viewed from the outside. In addition, when the light emitting member 511 is turned off, the door 20 defines an appearance which seems to have no information-displaying component such as the display 211.

The touch manipulating portion 212 is a portion in which a user manipulates to operate the refrigerator 1, may be disposed in a partial area of the front surface of the door 20, and may be located under or adjacent to the display 211.

The press-sensing portion of the touch manipulating portion 212 is subjected to surface processing such as printing or etching so that the user may see the manipulating portion.

In addition, a touch sensor assembly 70 described below may be disposed inside of the door 20 corresponding to the touch manipulating portion 212 and may sense the user-pressing operation on the touch manipulating portion 212.

Hereinafter, the arrangement structure of the display assembly 40 and the touch sensor assembly 70 is described in more detail with reference to the drawings.

Figure 4:
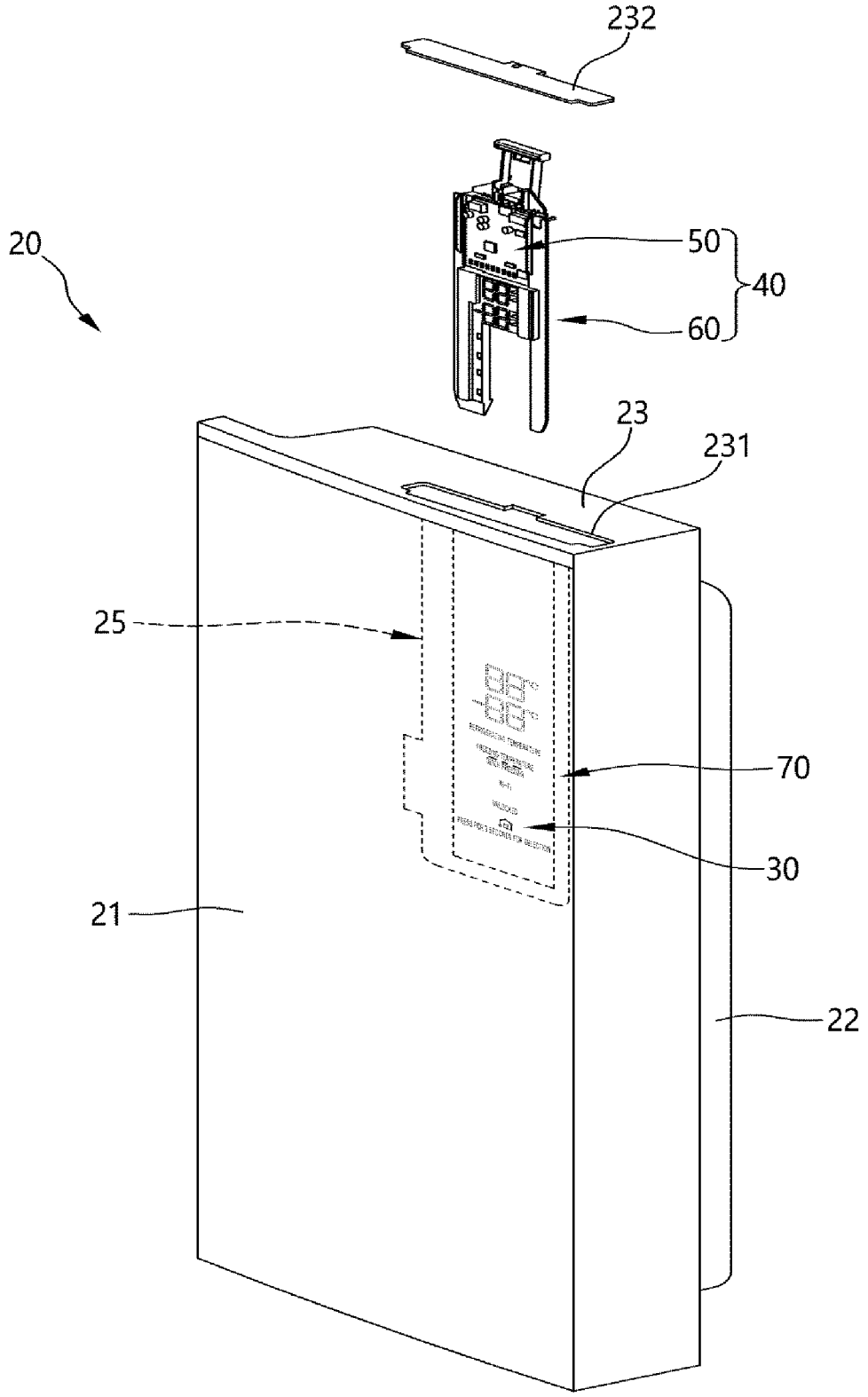
FIG. 4 is an exploded perspective view of an outer plate of the door.
Figure 5:
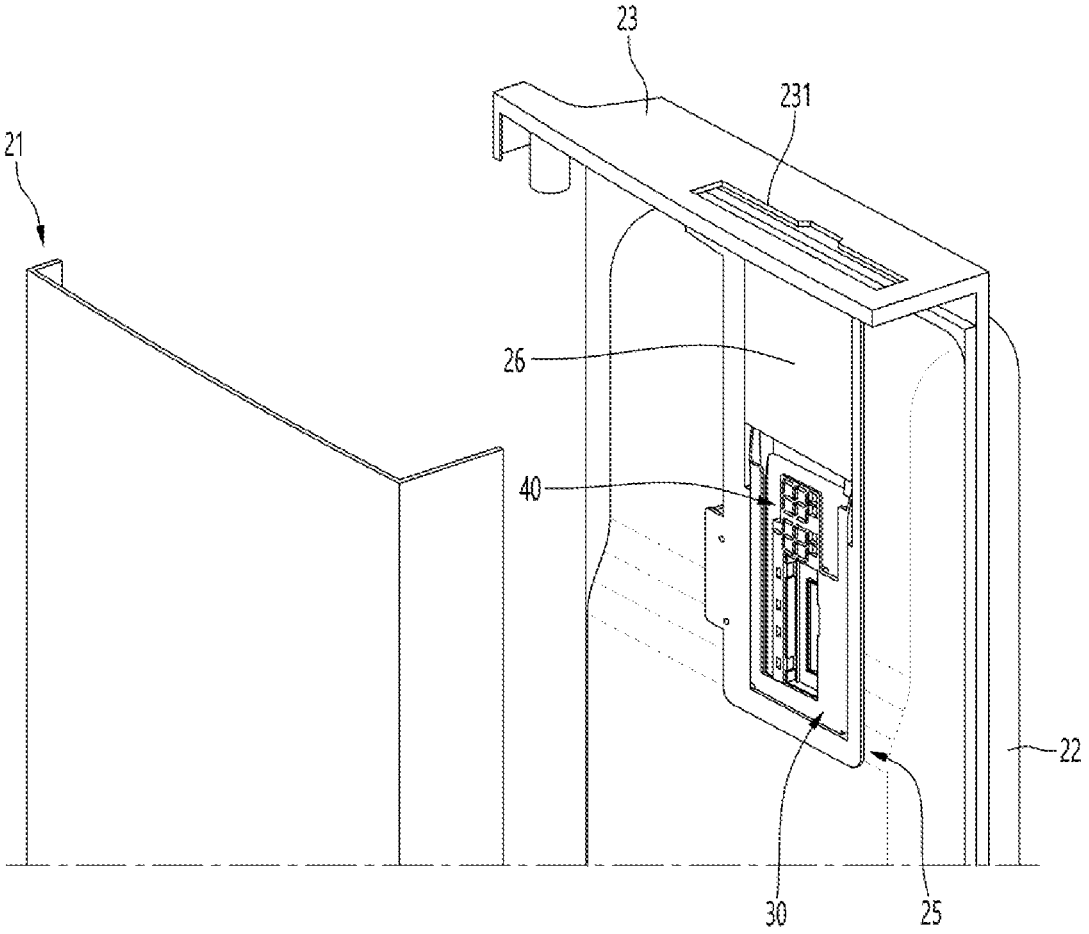
FIG. 5 is an exploded perspective view of a display assembly separated from the door.
Figure 6:
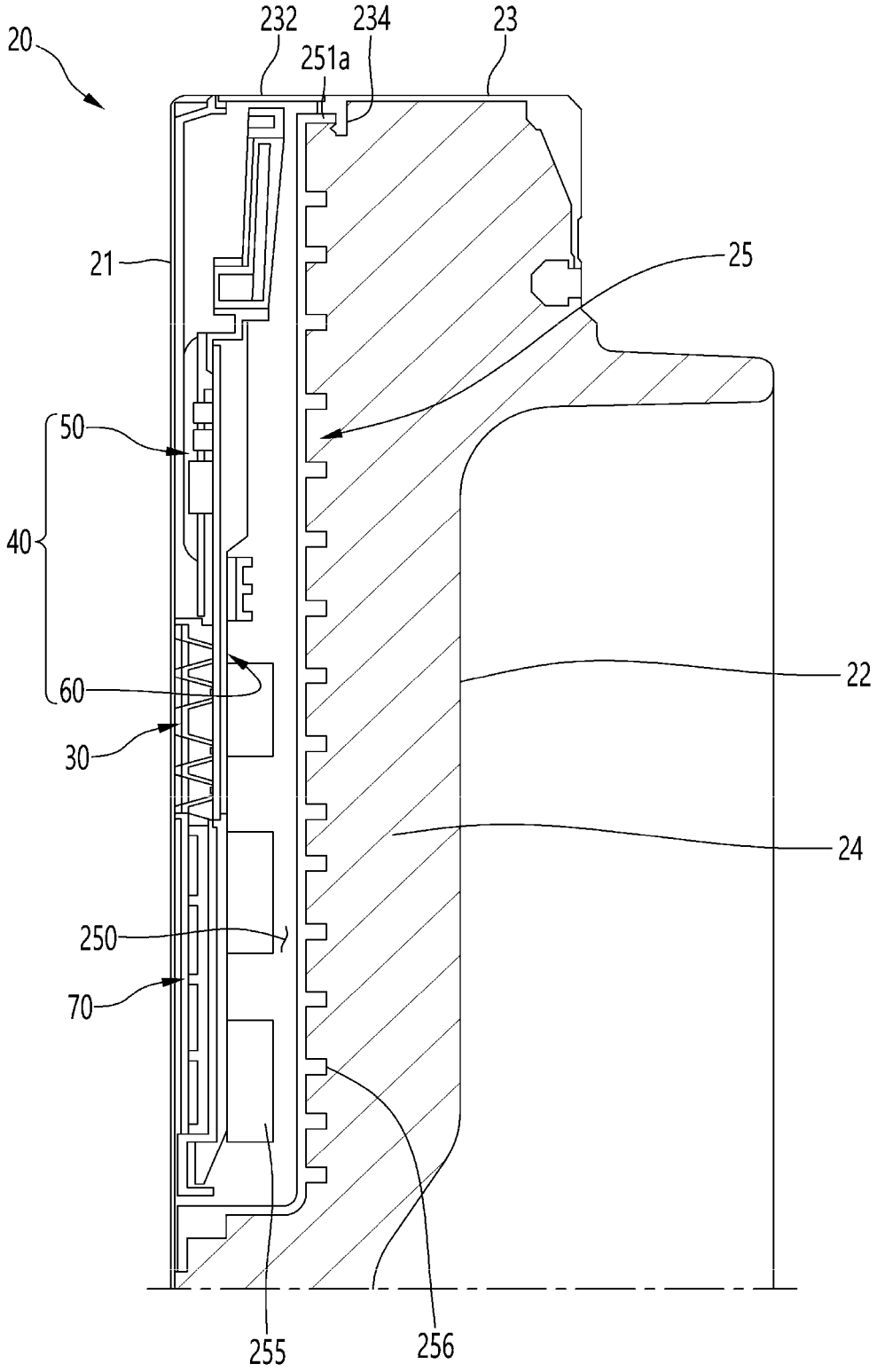
FIG. 6 is a cross-sectional view taken along line 6-6' of FIG. 2.

FIG. 4 is an exploded perspective view of a separated outer plate of the door. FIG. 5 is an exploded perspective view of a display assembly separated from the door. FIG. 6 is a cross-sectional view taken along line 6-6' of FIG. 2.

As shown, an outer appearance of the door may be defined by an outer plate 21, a door liner 22, and a cap decoration 23 and an insulating material 42 may be formed in an inner space of the door 20 assembled by coupling the outer plate 21, the door liner 22, and the cap decoration 23. The insulating material 42 may be foam-molded by injecting foaming liquid.

An inner case 25 may be disposed inside of the door 20 to provide a space to accommodate a display cover 30, a display assembly 40, and a touch sensor assembly 70. An upper side of the inner case 25 may be coupled to a lower surface of the cap decoration 23 and a front circumference of the inner case 25 may be coupled to the outer plate 21 to provide a predetermined space. The inner case 25 forms an independent space to prevent penetration of the foaming liquid when the foaming liquid is injected into the door 20. Therefore, the inner case 25 provides the space to accommodate the display assembly 40 and the touch sensor assembly 70.

In addition, the display cover 30 may be disposed in an inner space of the inner case 25 to mount the display assembly 40. The display cover 30 may contact a rear surface of the outer plate 21. The display cover 30 has an opening at an upper side thereof and the display assembly 40 may be inserted through the opening from a top to a bottom thereof.

In addition, a reinforcing plate 26 may be further disposed between an upper side of the display cover 30 and the cap decoration 23. The reinforcing plate 26 is attached to a rear surface of the outer plate 21 and may prevent the outer plate 21 from being bent into the inner space of the inner case 25.

The opened upper surface of the inner case 25 may communicate with a decoration opening 231 of the cap decoration 23. In addition, the decoration opening 231 may be opened and closed by a decoration cover 232. In addition, the display assembly 40 may be inserted into the inner space of the inner case 25 by the operation of the decoration cover 232.

In this case, the display cover 30 has an open top surface, and when the display assembly 40 is inserted into the inner case 25, the display assembly 40 may be inserted through the open top surface of the display cover 30. The display assembly 40 may be completely inserted into the display cover 30 by its own weight. In addition, when the decoration cover 232 closes the decoration opening 231, a lower surface of the decoration cover 232 presses an upper surface of the display assembly 40 to completely insert the display assembly 40.

In addition, the display assembly 40 is guided to be mounted at an accurate position when the display assembly 40 is inserted into the display cover 30. That is, the display assembly 40 and the display cover 30 have a plurality of structures that are in contact with each other or are assembled to each other, and with this structure, the display assembly 40 may be mounted at the accurate position of the display cover 30.

When the display assembly 40 is mounted at the accurate position inside of the display cover 30, the light emitting member 511 and the third through-hole 614 of the display assembly 40, the second through-hole 312 of the display cover 30, and the first through-hole 213 of the outer plate 21 may be aligned to communicate with one another. When the light emitting member 511 is turned on, the light may be transmitted to the outside from the light emitting member 511 by sequentially passing through the third through-hole 614, the second through-hole 312, and the first through-hole 213.

Figure 7:
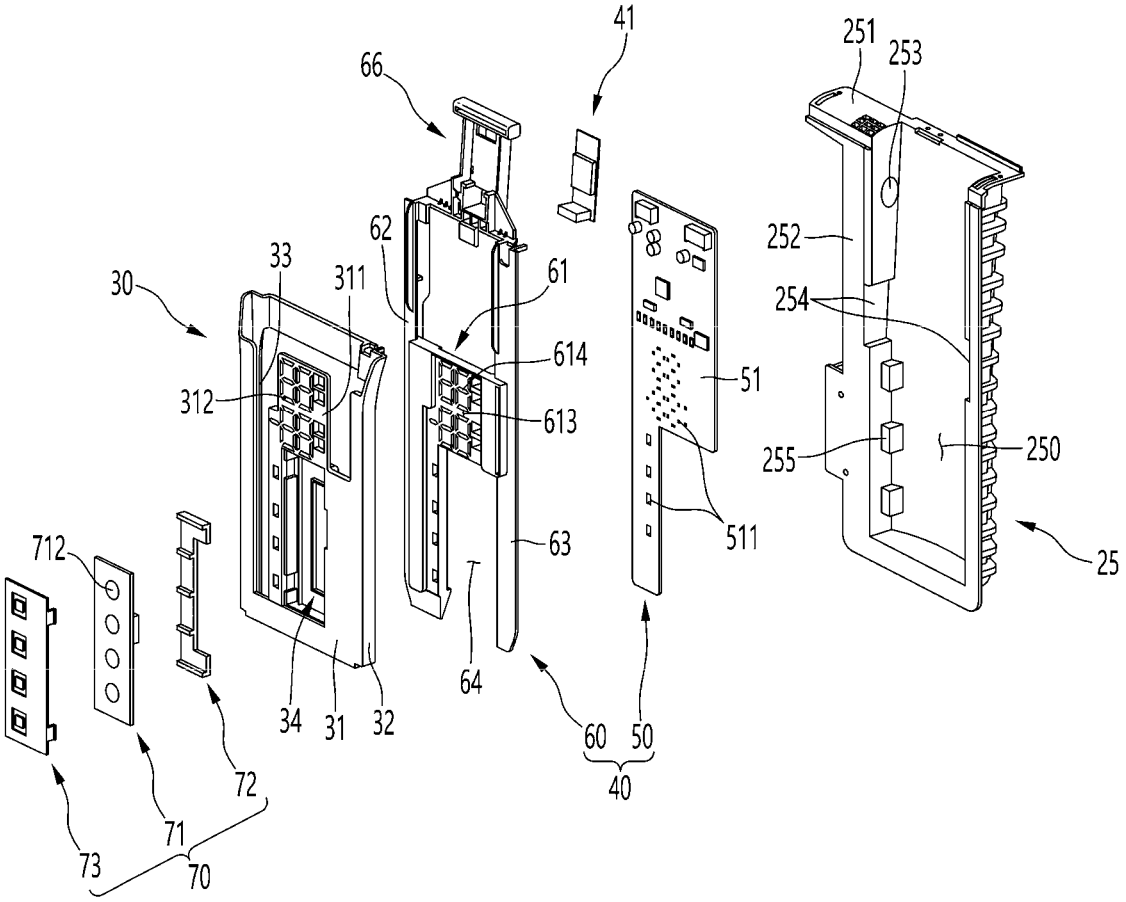
FIG. 7 is an exploded perspective view of a display cover, a display assembly, a touch assembly, and an inner case disposed inside of a door.

FIG. 7 is an exploded perspective view of a display cover, a display assembly, a touch assembly, and an inner case disposed inside of a door.

As shown in the drawing, an inner case 25 may be disposed inside of a door 20, a display cover 30 may be disposed in an inner area of the inner case 25, and a display assembly 40 and a touch sensor assembly 70 may each be disposed in the display cover 30.

The inner case includes a case upper surface 251 and a case front surface 252 and provides a space 250 opened to the front and the top. The case upper surface 251 contacts a cap decoration 23 and the case front surface 252 contacts a rear surface of an outer plate 21. In addition, the case front surface 252 may be defined along a remaining circumference of the inner case 25 except for an upper side of the space 250.

In addition, a reinforcing rib 256 is disposed on a rear surface of the inner case 25 to prevent deformation of the inner case 25 by a pressure during the molding of an insulating material 24. In addition, a wire hole 253 may be defined at an upper portion of the inner case 25, may pass through a side of the inner case 25, and wires connecting the display assembly 40 and the touch sensor assembly 70 disposed inside of the inner case 25 are inserted into or are taken out from the wire hole 253.

In addition, cover supporters 255 that protrude inward may be disposed on left surface and right surface of the space of the inner case 25. The cover supporter 255 may support the display cover 30 from the rear and the display cover 30 may contact the rear surface of the outer plate 21.

In addition, a case groove 254 may be defined above the cover supporter 255 and may be recessed laterally. The case groove 254 provides a space to accommodate an upper guide 321 at the upper portion of the display cover 30.

The display cover 30 may be disposed inside of the inner case 25. A cover front surface 31 of the display cover 30 may contact the rear surface of the outer plate 21. In addition, a cover rear surface 33 may be spaced apart from the cover front surface 31 and a space to accommodate the display assembly 40 may be defined by a cover circumferential surface 32 connecting the cover front surface 31 and the cover rear surface 33.

In addition, the display cover 30 may include a cover light guide 311 having a plurality of second through-holes 312. In addition, a sensor assembly mounting portion 34 may be recessed from the cover front surface 31 to mount the touch sensor assembly 70.

The display assembly 40 may include a display printed circuit board (PCB) 50 to mount the light emitting member 511 and a display frame 60 to couple and mount the display PCB 50 and inserted through the decoration opening 231 from an outside of the door 20.

In addition, the display frame 60 may include a handle 66, a first side extension portion 62 and a second side extension portion 63 that extend from both sides and are spaced apart from each other, and a frame light guide 61 connecting the first side extension portion 62 and the second side extension portion 63. The frame light guide 61 may include a third through-hole 614 that communicates with the second through-hole 312. In addition, a Wi-Fi module 41 may be disposed on the handle 66.

The touch sensor assembly 70 may include a touch PCB 71 to mount the touch sensor 712, an elastic member 72 to elastically support the touch PCB 71, and a touch cover 73 to cover the touch PCB 71. The elastic member 72, the touch PCB 71, and the touch cover 73 may be sequentially mounted on the sensor assembly mounting portion 34.

The inner case 25 may be coupled to each of the outer plate 21 and the cap decoration 23. When the inner case 25 is mounted at the accurate position and maintains the mounted state, positions of the light emitting members 511 may be maintained to correspond to those of the plurality of through-holes 213, 312, and 614. Therefore, the inner case 25 may have a coupling structure with the cap decoration 23.

Hereinafter, the coupling structure between the inner case 25 and the cap decoration 23 is described in more detail with reference to the drawings.

Figure 8:
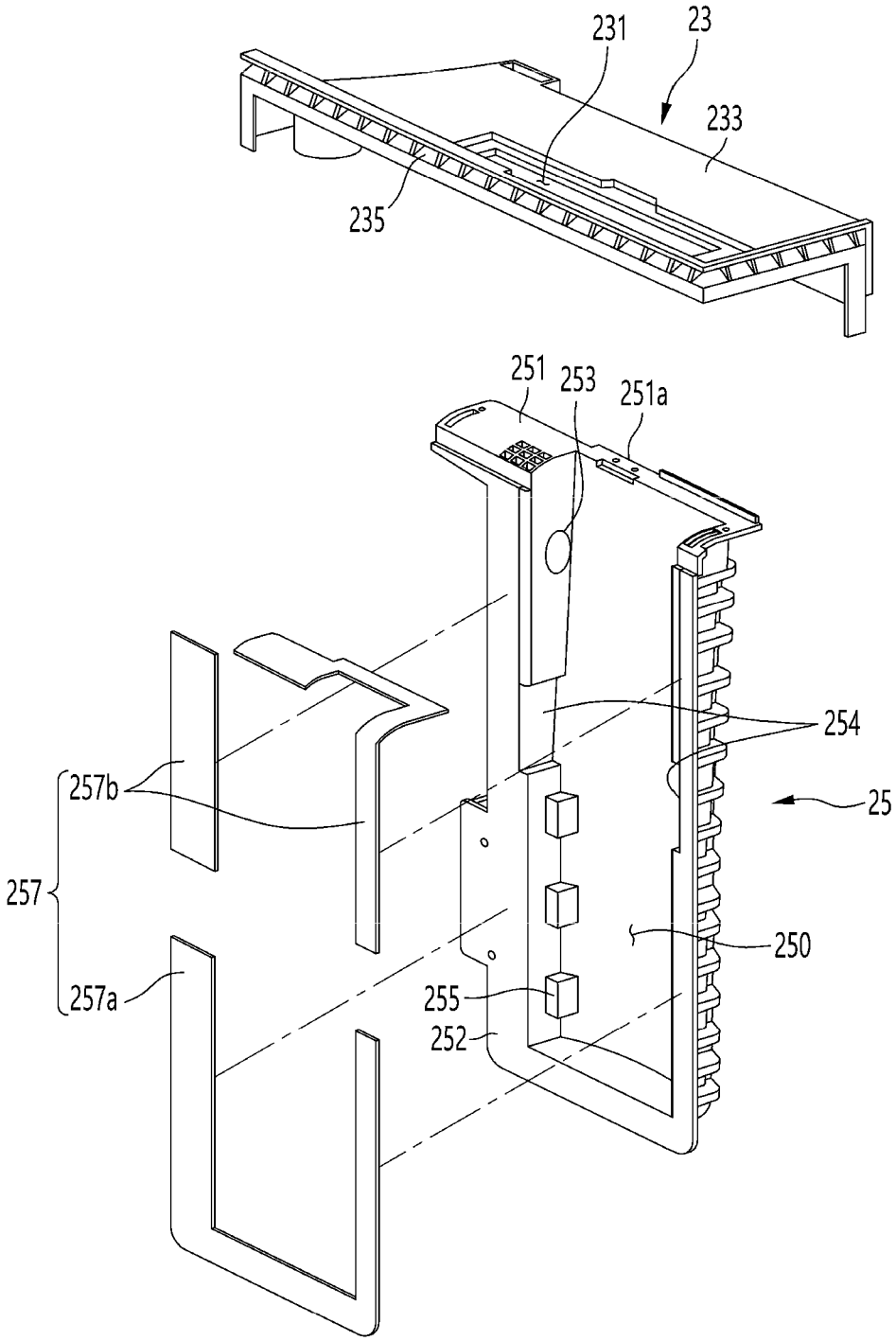
FIG. 8 is an exploded perspective view of a cap decoration and an inner case of the door.

FIG. 8 is an exploded perspective view of a cap decoration and an inner case of the door.

As shown in the drawing, a case upper surface 251 of an inner case 25 may be coupled to a lower surface of a cap decoration 23. In addition, a case front surface 252 of the inner case 25 may be coupled to an inner surface of an outer plate 21.

The inner case 25, the cap decoration 23, and the outer plate 21 may be assembled before foaming liquid is injected into a door 20 to form an insulating material 24. In this case, a sealing member 257 may be disposed between the inner case 25, the outer plate 21, and the cap decoration 23.

The sealing member 257 seals a space between the case upper surface 251 and the cap decoration 23, and a space between the case front surface 252 and the outer plate 21 to prevent introduction of the foaming liquid when the foaming liquid is injected into the door 20 for molding the insulating material 24. For the sealing, the sealing member 257 may be made of compressible material. In addition, the sealing member 257 may be attached along the case upper surface 251 and the case front surface 252.

A portion of the sealing member 257 may be made of adhesive material and may remain mounted at the accurate position. The sealing member 257 may include an upper sealing member **257*b* disposed at an upper portion of the inner case 25 and a lower sealing member 257*a* disposed at a lower portion of the inner case 25**.

The upper sealing member **257*b* may be disposed on the case upper surface 251 and a portion of an upper portion of the case front surface 252. In addition, a surface of the upper sealing member 257*b* may be attached to an inside of the inner case 25. Accordingly, the upper sealing member 257*b* may pressurize and contact the cap decoration 23 and the outer plate 21 when the inner case 25 is coupled. The upper sealing member 257*b* may not have a simple contact structure in which the cap decoration 23 and the outer plate 21 are adhered, but may have a sealing structure by compression owing to an upper surface of the inner case 25 inserted to the lower surface of the upper cap decoration 23** by rotation.

The lower sealing member **257*a* may be disposed below the upper sealing member 257*b* and may be located along the case front surface 252 at the lower portion of the inner case 25. In addition, both surfaces of the lower sealing member 257*a* may be adhered. For example, the lower sealing member 257*a* may have a structure like a double-sided tape. A first surface of the lower sealing member 257*a* may be adhered to the case front surface 252 and a second surface of the lower sealing member 257*a* may be adhered to the inner surface of the outer plate 21**.

The structure allows for easy coupling between the inner case 25 and the cap decoration 23 and firm fixing of the inner case 25 by adhesion between the inner case 25 and the outer plate 21.

The case upper surface 251 may be coupled to the lower surface of the cap decoration 23. In addition, when the inner case 25 is mounted, a decoration opening 231 of the cap decoration 23 may communicate with an accommodating space 250 of the inner case 25. Therefore, the display assembly 40 may be inserted into the inner case 25 by the cap decoration 23.

Hereinafter, the coupling structure of the cap decoration 23 and the inner case 25 is described in more detail with reference to the drawings.

Figure 9:
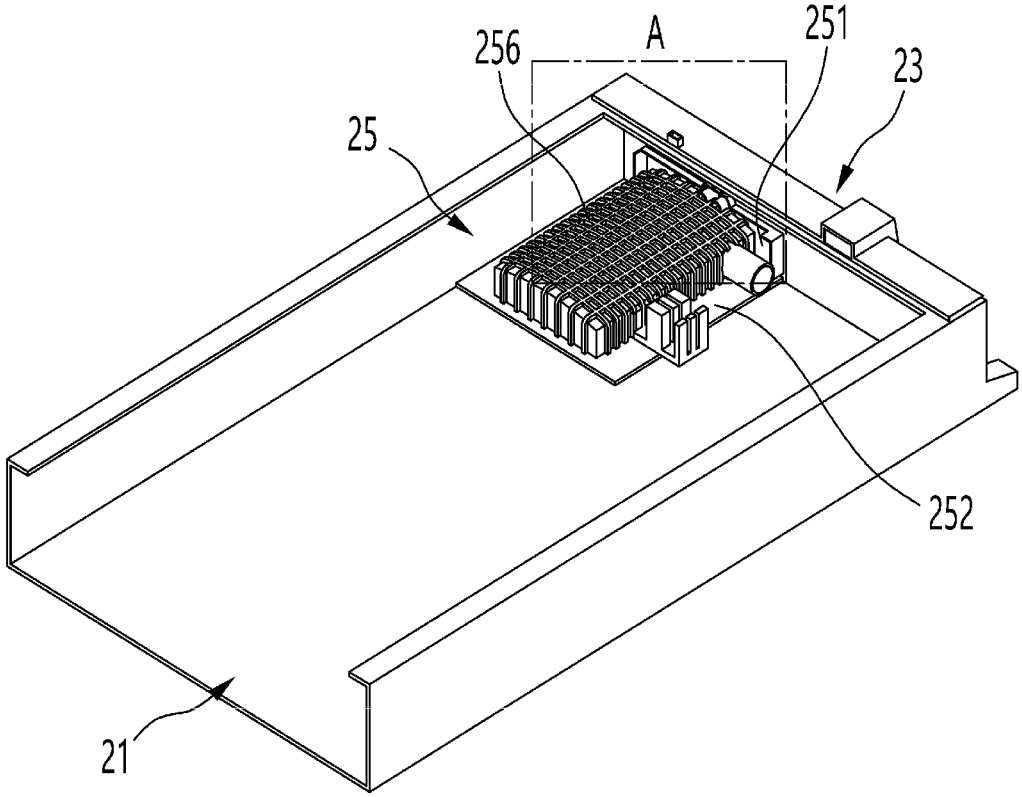
FIG. 9 shows a state of assembly between the door plate, a cap decoration, and an inner case.
Figure 10:
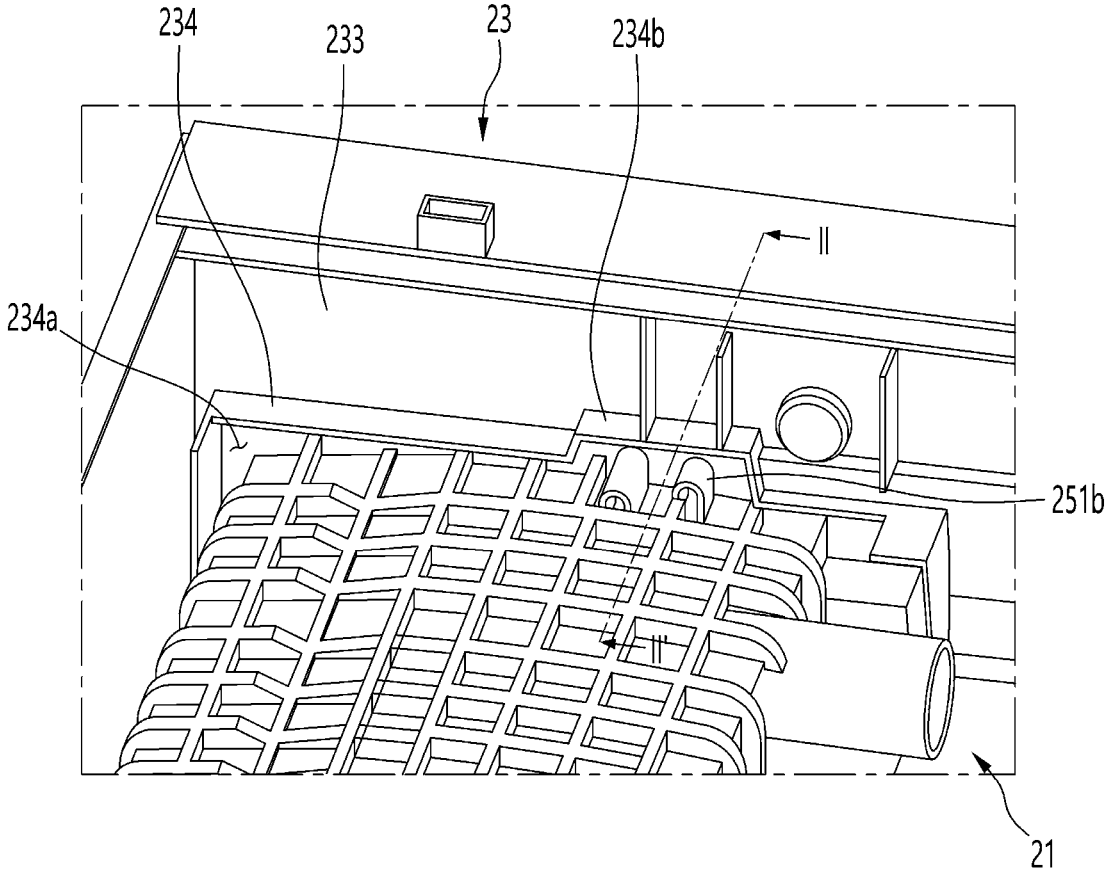
FIG. 10 is an enlarged view of a portion A of FIG. 9.
Figure 11:
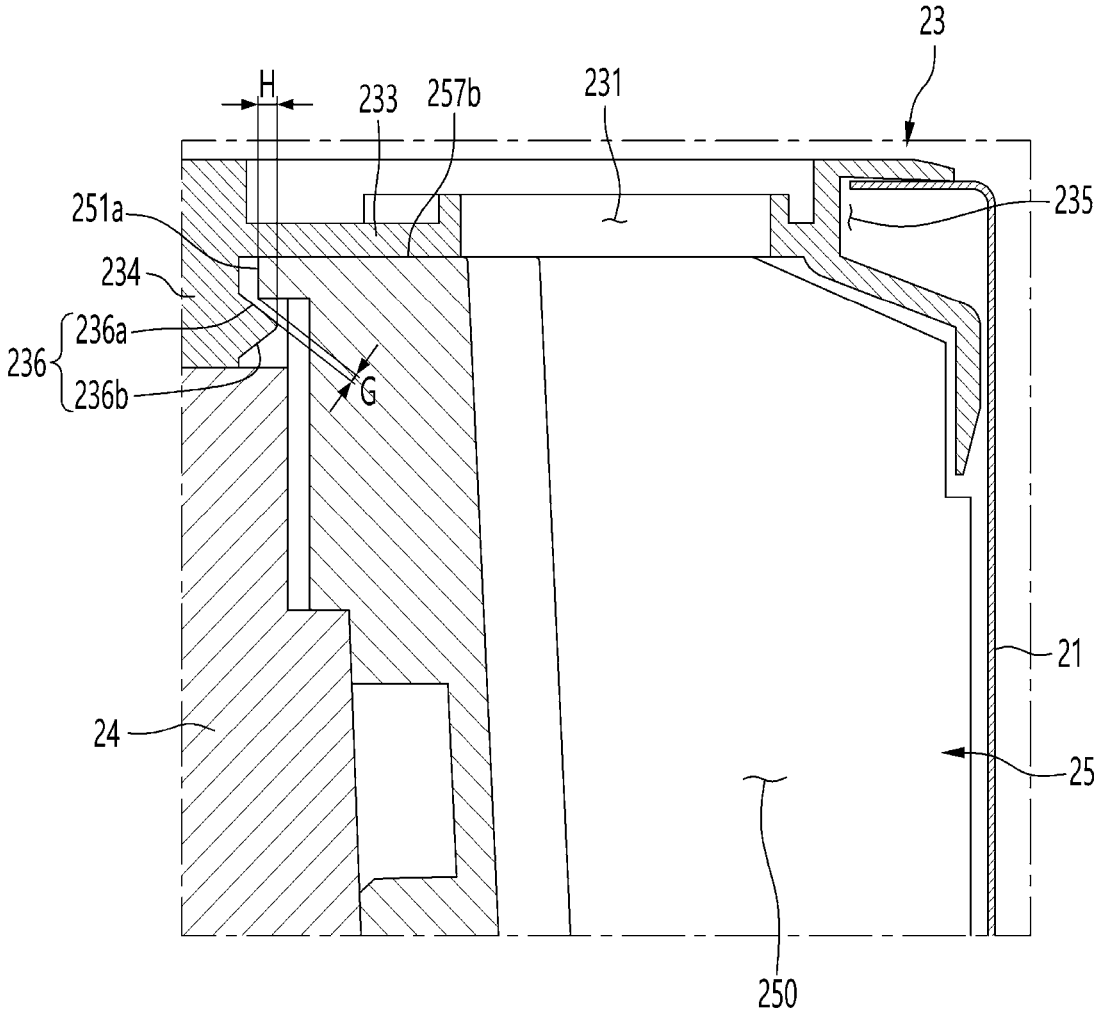
FIG. 11 is a cross-sectional view taken along line II-II' of FIG. 10.

FIG. 9 shows a state of assembly between the door plate, a cap decoration, and an inner case. FIG. 10 is an enlarged view of a portion A of FIG. 9. FIG. 11 is a cross-sectional view taken along line II-II' of FIG. 10.

As shown in the drawing, a door 20 may be assembled by coupling an outer plate 21, a cap decoration 23, and an inner case 25 before foaming for molding of an insulating material 24.

In this case, an upper surface 233 of the cap decoration 23 may define an upper appearance of the door 20 and a plate inserting portion 235 may be disposed along a circumference of the upper surface 233 of the cap decoration 23. The plate inserting portion 235 may have a groove shape such that a bending end of the outer plate 21 may be inserted into the groove and may be disposed on a front surface and both sides of the upper surface 233 of the cap decoration 23. Accordingly, an upper side of the outer plate 21 may be coupled to the circumference of the upper surface 233 of the cap decoration 23.

In addition, a case inserting portion 234 may be disposed on the upper surface 233 of the cap decoration 23 and may extend downward to accommodate an upper side of the inner case 25. The case inserting portion 234 may extend downward from the upper surfaces 233 of the cap decoration 23 in the inner surface of the door 20, and the case upper surface 251 may be inserted into and coupled to the case inserting portion 234.

The case inserting portion 234 may have a shape corresponding to that of the case upper surface 251 and may be defined along the position corresponding to that of the case upper surface 251. The case inserting portion 234 includes an insertion space 234*a* that is opened downward, and the inner case 25 is moved from the bottom to the top and the case upper surface 251 may be inserted into the insertion space 234*a*.

In addition, the case inserting portion 234 may contact along a circumference of the case upper surface 251. Accordingly, the inner case 25 may be aligned at the accurate position of the cap decoration 23 when the upper surface of the inner case 25 is inserted into the insertion space 234*a* of the case inserting portion 234.

Both ends of the case inserting portion 234 may contact the inner surface of the outer plate 21. Both side surfaces of the case inserting portion 234 may extend rearward and a rear surface thereof may be connected between the extending ends of both side surfaces of the case inserting portion 234. The insertion space 234*a* may be formed by coupling the case inserting portion 234 defining three surfaces of the insertion space 234*a* and the outer plate 21 defining a remaining surface of the insertion space 234*a*. When the inner case 25 is mounted, the front surface of the case upper surface 251 may contact the outer plate 21 and the remaining three surfaces of the case upper surface 251 may contact the case inserting portion 234.

In addition, the case inserting portion 234 may further define a protrusion 234*b* that protrudes rearward at a portion of a rear surface of the case inserting portion 234. In addition, the protrusion 234*b* may receive a fastening portion 251*b* that protrudes rearward from the upper surface of the inner case 25. That is, the protrusion 234*b* may have a shape corresponding to that of the fastening portion 251*b*. In addition, a screw may be fastened to the fastening portion 251*b* through the cap decoration 23. In addition, when the decoration cover 232 is mounted, the screw may sequentially pass through the decoration cover 232 and the cap decoration 23 and may be fastened to the fastening portion 251*b*. The decoration cover 232, the cap decoration 23, and the inner case 25 may be firmly coupled by fastening the screw.

The decoration opening 231 may be defined in the inner area of the insertion space 234*a*, and when the case upper surface 251 is inserted into and mounted in the insertion space 234*a*, the decoration opening 231 may communicate with an inside of the accommodating space 250 of the inner case 25.

A restraining protrusion 236 that protrudes inward may be defined at the extending end of the case inserting portion 234. The restraining protrusion 236 may protrude to the inside of the accommodating space 250 and a height of a protruding end of the restraining protrusion 236 may be taller than a position of a restraining end 251*a* of the case upper surface 251 by a set height (H) when the inner case 25 is mounted. For example, as the set height (H) is 1 mm or more, a sufficient amount of engagement and restraint may be obtained.

That is, the restraining protrusion 236 may protrude forward than the restraining end 251*a* of the case upper surface 251 by the set height. When the upper surface of the inner case 25 is mounted, the restraining end 251*a* of the case upper surface 251 may be engaged with and restrained by the restraining protrusion 236, thereby blocking separation of a rear end of the inner case 25.

The restraining protrusion 236 may be defined entirely along the case inserting portion 234. In addition, a plurality of restraining protrusions 236 may be arranged along the case inserting portion 234 by a predetermined distance.

The restraining protrusion 236 may be inclined to insert the restraining end 251*a* of the inner case 25 when the inner case 25 is mounted. In detail, the upper surface 236*a* of the restraining protrusion 236 may be inclined downward toward a protruding portion. In addition, the lower surface 236*b* of the restraining protrusion 236 may be inclined upward toward a protruding portion. Accordingly, a point where the upper surface 236*a* and the lower surface 236*b* meet may be a furthest protruding portion of the restraining protrusion 236.

With this structure, when the inner case 25 is mounted, the restraining end 251*a* of the case upper surface 251 may be inserted through the restraining protrusion 236, and in the insertion state, the restraining end 251*a* may be engaged and restrained.

An extending line of the inclined upper surface 236*a* and the restraining end 251*a* of the case upper surface 251 may be spaced apart from each other by a set distance (G). The set distance (G) is determined in consideration of a compression amount of an upper sealing member 257*b* attached to the case upper surface 251 when the inner case 25 is inserted and mounted, and when the inner case 25 is mounted, the upper sealing member 257*b* may be compressed. Therefore, the set distance (G) may be smaller than a thickness of the upper sealing member 257*b*, and for example, the set distance (G) may be about 0.3 mm.

Hereinafter, an assembly process of the inner case 25 having the above structure is described with reference to the drawings.

Figure 12:
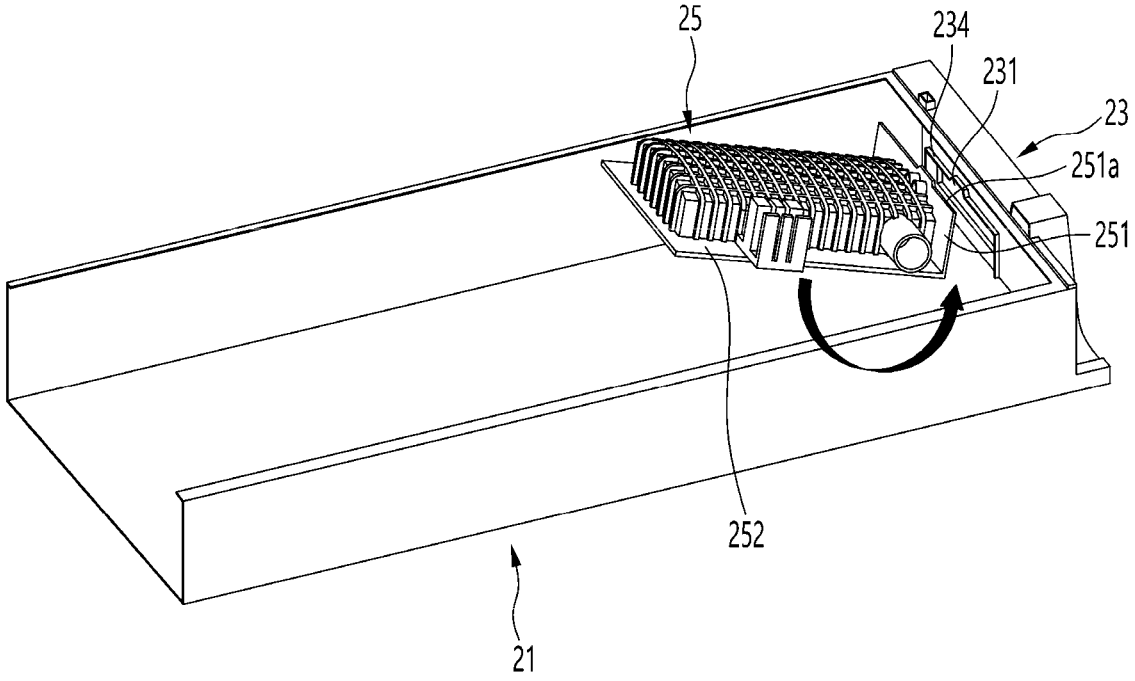
FIG. 12 shows an assembly process of the inner case.

FIG. 12 shows an assembly process of the inner case.

As shown in the drawing, an outer plate 21 and a cap decoration 23 are coupled to each other before an inner case 25 is assembled. The outer plate 21 may be coupled to the cap decoration 23 by inserting a bent upper side of the outer plate 21 into a plate inserting portion 235 of the cap decoration 23. The outer plate 21 may be additionally restrained when the outer plate 21 is coupled to the cap decoration 23.

The inner case 25 is mounted in a state in which the cap decoration 23 is coupled to the outer plate 21. An upper sealing member 257*b* and a lower sealing member 257*a* of the inner case 25 may be attached to a case upper surface 251 and a case front surface 252 before the inner case 25 is mounted. In addition, the lower sealing member 257*a* may have an additional adhesive structure for adhesion to the outer plate 21.

In order to mount the inner case 25, the inner case 25 is arranged to face the case upper surface 251 upward and face the case front surface 252 forward and the case upper surface 251 is moved upward from downward to face the case inserting portion 234.

In this case, the inner case 25 is moved upward in a tilted state in which a lower surface of the inner case 25 is separated from the outer plate 21 and an upper surface of the inner case 25 contacts the outer plate 21 and the case upper surface 251 is inserted into the case inserting portion 234.

That is, the inner case 25 is moved upward to insert the case upper surface 251 into the case inserting portion 234, and a lower portion of the inner case 25 may be moved by rotating counterclockwise (see FIG. 12). By the mounting, a restraining end 251*a* of the case upper surface 251 may be inserted through a restraining protrusion 236 of the case inserting portion 234.

The upper sealing member 257*b* may not affect the coupling process of inserting the upper surface of the inner case 25 into the upper surface 233 of the cap decoration 23 in the tilted state and engaging and restraining the cap decoration 23 and the inner case 25 with each other based on the rotation. When the inner case 25 is coupled to the cap decoration 23, the upper sealing member 257*b* may be pressurized to seal between the inner case 25 and the cap decoration 23.

In addition, when the lower portion of the inner case 25 is rotated in a state in which an upper portion of the inner case 25 is fixed, the lower sealing member 257*a* may contact an inner surface of the outer plate 21 and the case front surface 252 may contact the outer plate 21.

When the inner case 25 is coupled, the case upper surface 251 may contact the upper surface 233 of the cap decoration 23 and the restraining end 251*a* of the case upper surface 251 may be restrained by the restraining protrusion 236 of the case inserting portion 234, and the case upper surface 251 and the upper surface 233 may be sealed by the upper sealing member 257*b*. In addition, the case front surface 252 and the outer plate 21 may contact each other and may be sealed.

In this state, the door liner 22 and additional components of the door 20 are coupled and the foaming liquid is injected into the door 20 to from the insulating material 24. In addition, even if the foaming liquid is injected when molding the insulating material 24, the foaming liquid may not penetrate between the inner case 25 and the cap decoration 23 or the inner case 25 and the outer plate 21.

Various other embodiments of the present disclosure are possible in addition to the above-described embodiments. According to another embodiment of the present disclosure, the inner case 25 is more firmly restrained by the restraining protrusion 236. Other embodiments of the present disclosure are the same as the above-mentioned embodiment except for the shape of the restraining protrusion 236. The same reference numerals are used for the same components as in the above-mentioned embodiment and a description thereof is omitted.

Figure 13:
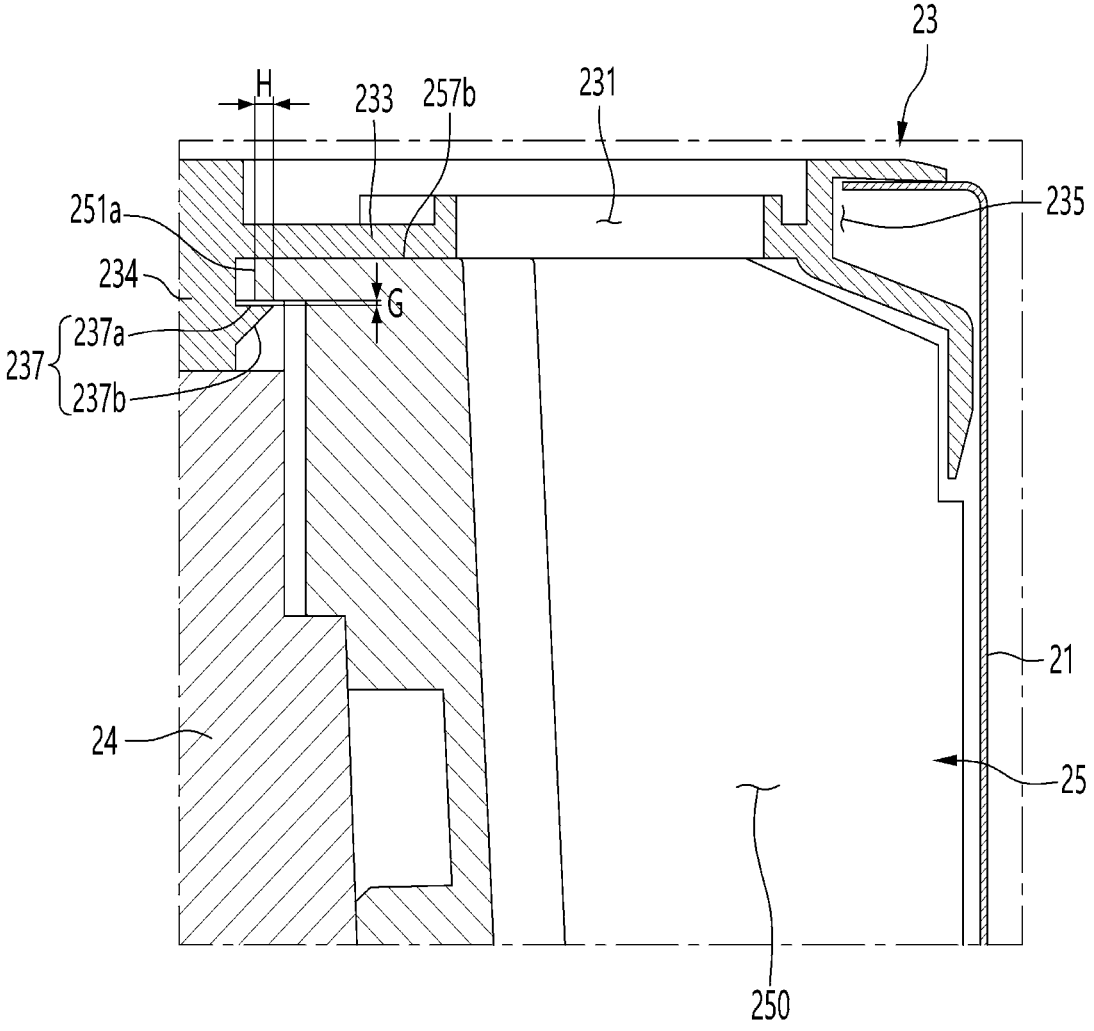
FIG. 13 is a cross-sectional view of a coupling structure of a cap decoration and an inner case of a door according to another embodiment of the present disclosure.

FIG. 13 is a cross-sectional view of a coupling structure of a cap decoration and an inner case of a door according to another embodiment of the present disclosure.

As shown, a bending end of an outer plate 21 may be inserted into a plate inserting portion 235 around a cap decoration 23. The inner case 25 may be coupled in a state in which the outer plate 21 and the cap decoration 23 are coupled.

When the inner case 25 is coupled, a case upper surface 251 may contact an upper surface 233 of the cap decoration 23, and a space between the case upper surface 251 and the upper surface 233 may be sealed by an upper sealing member 257*b*. In addition, a restraining end 251*a* of the case upper surface 251 may be restrained by a restraining protrusion 237 when the inner case 25 is coupled to the cap decoration 23.

The restraining protrusion 237 may protrude to an inside of an accommodating space 250 and a height of a protruding portion of the restraining protrusion 237 may be taller than a position of the restraining end 251*a* of the case upper surface 251 when the inner case 25 is mounted by a set height (H). For example, the set height may be equal or greater than 1 mm and a sufficient amount of engagement and restraint may be obtained.

That is, the restraining protrusion 237 may protrude forward from the restraining end 251*a* of the case upper surface 251 by the set height. Therefore, when the case upper surface 251 is mounted, the restraining end 251*a* of the case upper surface 251 may be engaged with and restrained by the restraining protrusion 237 to prevent separation of a rear end of the inner case 25.

In this case, an upper surface 237*a* of the restraining protrusion 237 may extend in parallel to the upper surface 233 of the cap decoration 23, and when the inner case 25 is mounted, the restraining end 251*a* of the case upper surface 251 is firmly restrained by the restraining protrusion 237 to block the rear end of the inner case 25 from being easily separated.

An extending line of the upper surface 237*a* and the restraining end 251*a* of the case upper surface 251 may be spaced apart from each other by a set distance (G). The set distance (G) is determined in consideration of a compression amount of the upper sealing member 257*b* attached to the case upper surface 251 when the inner case 25 is inserted and mounted, and when the inner case 25 is mounted, the upper sealing member 257*b* may be compressed. In this case, the set distance (G) may be smaller than a thickness of the upper sealing member 257*b*, and for example, may be about 0.3 mm.

A lower surface 237*b* of the restraining protrusion 237 may be inclined upward toward a protruding portion. Accordingly, the restraining end 251*a* of the inner case 25 may be moved upward along the inclined lower surface 237*b* when the inner case 25 is inserted while moving upward from downward.

When the inner case 25 is coupled to and is completely restrained by the cap decoration 23, the case front surface 252 may be adhered to and coupled to the inner surface of the outer plate 21.

In addition, when the inner case 25 is fixedly coupled to the cap decoration 23 and the outer plate 21, other components of the door 20 including the door liner 22 are further assembled and the foaming liquid is injected to complete the assembly of the door 20.

What is claimed is:

1. A refrigerator comprising:

a cabinet; and a door configured to open and close the cabinet, wherein the door comprises:

a cap defining an upper surface of the door, an outer plate having a front surface and a rear surface, the front surface defining a front appearance of the door, the outer plate comprising a display configured to indicate operation information at the front surface, and an inner case disposed at the rear surface of the outer plate and coupled to the display, the inner case defining an accommodating space, wherein a front surface of the inner case is coupled to the outer plate and an upper surface of the inner case is coupled to the cap, wherein the cap comprises a case inserting portion that restrains the upper surface of the inner case, wherein the inner case comprises a restraining end that extends along a circumference of the case upper surface, wherein the cap comprises a restraining protrusion that protrudes at an intermediate portion of the case inserting portion, the restraining protrusion being configured to be engaged with and restrained at the restraining end of the inner case, wherein a lower surface of the restraining protrusion includes an inclined surface, and wherein an upper surface of the restraining protrusion is configured to be engaged with and restrained at the restraining end of the inner case.

2. The refrigerator of claim 1, wherein the inner case comprises:

a case upper surface that defines the upper surface of the inner case and that contacts an inner upper surface of the cap; and a case front surface that extends away from the accommodating space and that contacts the rear surface of the outer plate.

3. The refrigerator of claim 2, further comprising a sealing tape disposed at the case upper surface and the case front surface and providing sealing between the inner case, the outer plate, and the cap.

4. The refrigerator of claim 3, wherein the sealing tape is made of a compressible material.

5. The refrigerator of claim 1, wherein a sealing tape is disposed between the upper surface of the inner case and the inner upper surface of the cap, wherein the upper surface of the restraining protrusion of the cap is vertically spaced apart from the restraining end of the inner case by a set distance, and wherein the set distance is smaller than a vertical thickness of the sealing tape.

6. The refrigerator of claim 1, wherein the inner case is configured to be inserted into the case inserting portion to thereby engage the restraining end of the inner case with the restraining protrusion of the cap and retrain the restraining end of the inner case at the restraining protrusion of the cap.

7. The refrigerator of claim 6, wherein the inner case is configured to be coupled to the outer plate based on a lower portion of the inner case being rotated toward the outer plate.

8. The refrigerator of claim 7, further comprising:

an upper sealing tape positioned at the case upper surface and an upper portion of the case front surface and providing sealing between the inner case and the cap; and a lower sealing tape positioned along the case front surface and providing sealing between the inner case and the outer plate.

9. The refrigerator of claim 8, wherein the upper sealing tape is adhered to the inner case, and wherein the lower sealing tape is adhered to the inner case and the outer plate.

10. The refrigerator of claim 9, wherein the upper sealing tape is adhered to the case upper surface, and wherein the lower sealing tape is adhered to the case front surface.

11. The refrigerator of claim 1, wherein the case inserting portion extends toward the inner case and is configured to contact an outer circumference of the upper surface of the inner case.

12. The refrigerator of claim 11, wherein the cap comprises an opening that communicates with the accommodating space, and wherein the refrigerator further comprises a decoration cover configured to cover an upper side of the opening to open and close the opening.

13. The refrigerator of claim 12, wherein the inner case includes a fastening portion positioned at an upper side of the inner case and configured to fasten a screw that extends through the decoration cover and the cap.

14. The refrigerator of claim 13, wherein the case inserting portion comprises a protrusion configured to accommodate the fastening portion of the inner case.

15. The refrigerator of claim 14, wherein the display defines a plurality of through-holes configured to indicate the operation information.

16. The refrigerator of claim 12, wherein a front side of the upper surface of the inner case is restrained at the outer plate, and wherein opposite lateral sides and a rear side of the upper surface of the inner case are restrained at the case inserting portion.

17. The refrigerator of claim 12, wherein the door comprises:

an insulating material included in the door.

18. The refrigerator of claim 17, further comprising:

a display assembly inserted through the opening of the cap and received in the accommodating space of the inner case.

* * * * *